US007267144B2

(12) United States Patent
Nyhof et al.

(10) Patent No.: US 7,267,144 B2
(45) Date of Patent: Sep. 11, 2007

(54) BULK BAG FILLING SYSTEM

(75) Inventors: Scott L. Nyhof, Hamilton, MI (US); Jesse L. Smith, Allegan, MI (US)

(73) Assignee: Material Transfer & Storage, Inc., Allegan, MI (US)

( * ) Notice: Subject to any disclaimer, the term of this patent is extended or adjusted under 35 U.S.C. 154(b) by 107 days.

(21) Appl. No.: 11/119,872

(22) Filed: May 2, 2005

(65) Prior Publication Data

US 2005/0241728 A1 Nov. 3, 2005

Related U.S. Application Data

(60) Provisional application No. 60/567,709, filed on May 3, 2004.

(51) Int. Cl.
*B65B 1/04* (2006.01)

(52) U.S. Cl. ..... 141/314; 141/114

(58) Field of Classification Search ..... 141/10, 141/313–316, 114; 53/468–473
See application file for complete search history.

(56) References Cited

U.S. PATENT DOCUMENTS

| | | | |
|---|---|---|---|
| 3,149,649 | A | 9/1964 | Hix |
| 4,054,161 | A | 10/1977 | Alack |
| 4,676,284 | A | 6/1987 | DeCrane |
| 4,863,065 | A | 9/1989 | Decrane |
| 4,872,493 | A | 10/1989 | Everman |
| 4,964,782 | A | 10/1990 | DeCrane |
| 5,033,935 | A | 7/1991 | Decrane |
| 5,036,893 | A | 8/1991 | DeCrane |
| 5,056,571 | A | 10/1991 | Derby |
| 5,320,251 | A | 6/1994 | Ellis |
| 5,348,063 | A | 9/1994 | Handleman |
| 5,354,166 | A | 10/1994 | DeCrane |
| 5,400,837 | A | 3/1995 | Kelley et al. |
| 5,494,189 | A | 2/1996 | DeCrane |
| 5,787,945 | A | 8/1998 | Riemersma |
| 5,788,449 | A | 8/1998 | Riemersma |
| 6,089,283 | A | 7/2000 | Sienerth et al. |
| 6,149,110 | A | 11/2000 | Gill et al. |
| 6,340,100 | B1 | 1/2002 | Gill et al. |
| 6,427,955 | B1 | 8/2002 | Sterner et al. |
| 6,564,534 | B2 | 5/2003 | Poulton et al. |
| 6,776,197 | B1 | 8/2004 | DeCrane |
| 7,004,212 | B2 * | 2/2006 | Gill et al. ..... 141/316 |

OTHER PUBLICATIONS

Flexicon Catalog, "More of what you want from a bulk food conveyor: Less of what you don't," 2005 (1 page).
Flexicon Catalog, "Bulk bag filling just got faster, safer and easier," 2004 (1 page).

(Continued)

*Primary Examiner*—Steven O. Douglas
(74) *Attorney, Agent, or Firm*—Price Heneveld Cooper DeWitt & Litton, LLP

(57) ABSTRACT

A bulk bag filling system includes a frame having a base, a fill carriage coupled to the frame and a rotary carriage. The fill carriage is alignable with a fill port for receiving a bulk material. The rotary carriage includes a plurality of bag loop hangers for receiving bag loops of a bag to be filled. The rotary carriage is movably coupled to the fill carriage and a spout, for receiving a neck of the bag to be filled, extends through the rotary carriage. The spout is alignable with the fill port.

21 Claims, 9 Drawing Sheets

OTHER PUBLICATIONS

Tech Pak, www.teck-pak.com/5000.htm, "Series 5000 Bulk Bag Filling Systems," Jul. 9, 2004, (3 pages).
Tech Pak, www.teck-pak.com/PAKRAT.html, "Pakrat Series 4400H/P Bag Filling System," Jul. 9, 2004 (3 pages).
Tech Pak, www.teck-pak.com/330e.html, "Quickpak Series 330E Bulk Bag Filling System," Jul. 9, 2004 (2 pages).
National Bulk Equipment, Inc., "Hang-weigh bulk bag fillers," 1999 (3 pages).

* cited by examiner

BULK BAG FILLING SYSTEM

This application claims the benefit of the filing date of U.S. Provisional Patent Application Ser. No. 60/567,709 entitled, "BULK BAG FILLING SYSTEM," by Scott L. Nyhof et al., filed May 3, 2004, the entire disclosure of which is hereby incorporated by reference.

BACKGROUND OF THE INVENTION

The present invention is generally directed to a filling system and, more specifically, to a bulk bag filling system.

A wide variety of filling systems have been utilized for bulk material handling. In general, systems that have been utilized to fill a bag with a bulk material have included stationary bag loop hangers that received bag loops of a bag to be filled. While many of these prior art bulk bag filling systems are satisfactory for low-volume filling, these systems are generally not suitable for high-volume production filling.

A common problem with bulk bag filling systems is the need for an operator to reach into the machine to access bag loop connection points and a bag spout connection point. Various manufacturers have attempted to address this issue by moving the rear most bag loop connection points forward, toward the operator. While this technique provides some relief, the technique fails to fully address the ergonomic issue of requiring an operator to reach into the machine to connect a bag, as the front and rear connection points still remain substantially over a base of the system. Another issue with prior art bulk bag filling systems is the bag spout connection point, which has been located considerably farther in over the base than the front bag loop connections points, has been fixed and, thus, has not been readily accessible to an operator.

Still other manufacturers have developed bulk bag filling systems with an assembly, which included bag loop connection points and a bag spout connection point, that has swung downward and forward to facilitate bag attachment. While this moves the bag loop connection points toward the operator, the fill spout is horizontal to the floor in the bag loading position. Thus, an operator must reach down, below hip level, and connect the lower bag loops while simultaneously supporting and properly orientating the bag. In this configuration, the operator is placed into an undesirable position while making these connections as the bag prevents the operator from properly bending at the knees. Furthermore, to load a bag, the operator is forced to bend with his/her back, while reaching a relatively long distance. Once the bottom bag loops are connected, the operator is still faced with the difficult task of connecting the bag spout onto the connection point.

In order to connect the spout, the operator has been required to get around a number of hurdles, i.e., the operator must hold the bulk bag with one hand, while simultaneously positioning the inlet spout of the bag over a horizontal fill spout. When the operator manages to slide the bag spout onto the connection point the operator must then maintain the position of the bag with one hand while reaching for the spout inflation switch. The operator must also reach up, above shoulder level, to connect the upper bag loops. All of the tasks listed above must be done while attempting to support and orientate a bag that, based on the general laws of physics and gravity, simply does not want to be in the position required to make the connection.

What is needed is an ergonomically designed bulk bag filling system that is capable of operating in a high-volume production environment.

SUMMARY OF THE INVENTION

In one automated embodiment of the present invention a bulk bag filling system includes a frame having a base, an input/output device attached to the frame, a fill carriage movably coupled to the frame, a rotary carriage, a processor and a memory subsystem. The input/output device is configured to receive input from an operator and provide output to the operator. The fill carriage includes a fill carriage actuator for effecting movement of the fill carriage and is alignable with a fill port for receiving a bulk material. The rotary carriage includes a plurality of bag loop hangers for receiving bag loops of a bag to be filled. The rotary carriage is movably coupled to the fill carriage and a spout, for receiving a neck of the bag to be filled, extends through the rotary carriage. The spout is alignable with the fill port and the rotary carriage includes at least one bag loop hanger actuator for effecting movement of a bag loop capture pin of the bag loop hangers. The processor is coupled to the input/output device, the fill carriage actuator and the bag loop hanger actuator, as well as the memory subsystem.

The memory subsystem stores code that, responsive to input from an operator, instructs the processor to perform a number of steps. One step includes controlling the fill carriage actuator to position the fill carriage into a bag loading position. Another step includes controlling the bag loop hanger actuator to position the bag loop capture pin in a bag loop receive position. The processor also controls the bag loop hanger actuator to position the bag loop capture pin in a bag loop capture position and, thereby, capture a bag loop, which has been positioned by the operator. The processor also controls the fill carriage actuator to position the fill carriage and the bag into a bag filling position for receipt of the bulk material.

According to another aspect of the present invention, the bulk bag filling system includes a bag spout sealing subsystem and a bag inflator subsystem. The bag spout sealing subsystem is positioned adjacent the spout and includes a bag spout seal and a bag spout sealing actuator that is coupled to the processor. The bag inflator subsystem includes a bag inflator actuator, which is coupled to the processor. The memory subsystem stores additional code that responsive to input provided by the operator instructs the processor to perform a number of additional steps. One step includes controlling the bag sealing actuator to inflate the bag seal, which seals the neck of the bag to the spout and, thereby, prevents dust from escaping during material transfer. The processor may also control the bag inflator actuator to inflate the bag for receiving the bulk material and, thus, allow the bag to properly fill.

According to another embodiment of the present invention, the bulk bag filling system includes a vibrator positioned in the base. The vibrator is coupled to the processor and the memory subsystem stores additional code that instructs the processor to perform the additional step of controlling the vibrator to vibrate the bulk material within the bag, as the bag is filled. According to another aspect of the present invention, the bulk bag filling system includes a scale positioned in the base. The scale is coupled to the processor and the memory subsystem stores additional code that instructs the processor to perform the additional step of receiving input from the scale, which is used to determine the weight of the bulk material within the bag, as the bag is filled. According to yet another embodiment of the present invention, the rotary carriage includes a rotary carriage actuator for effecting rotary movement of the rotary carriage.

According to a different aspect of the present invention, the bulk bag filling system includes a height adjustment actuator attached between the frame and the fill carriage for adjusting a vertical position of the fill carriage with respect to the frame. The height adjustment actuator is coupled to the processor and the memory subsystem stores additional code that instructs the processor to perform a number of additional steps. One step includes controlling the height adjustment actuator to adjust the height of the fill carriage to an operator selectable height, when the fill carriage is positioned in the bag loading position. This is advantageous in that it allows an operator to customize the height of the fill carriage during the bag loading operation. Another step includes controlling the height adjustment actuator to adjust the height of the fill carriage to a bag filling position height, when the fill carriage is positioned in the bag filling position. The processor also controls the bag loop hanger actuator to position the bag loop capture pin in a bag loop release position, when the scale indicates that the bag has reached a desired weight. Then, the processor controls the height adjustment actuator to adjust the height of the fill carriage to a bag unloading position height.

These and other features, advantages and objects of the present invention will be further understood and appreciated by those skilled in the art by reference to the following specification, claims and appended drawings.

DETAILED DESCRIPTION OF PREFERRED EMBODIMENTS

According to the present invention, a bulk bag filling system that exhibits user friendly ergonomic operation, while generally reducing the time required for a bag fill operation, is disclosed herein. According to various aspects of the present invention, the bulk bag filling system can be configured to include a fill head and a rotary head, including a plurality of bag loop hangers that extend toward the operator for effortless bag hanging. The bulk bag filling system may also be configured with a bag inflation subsystem that ensures the bag is properly filled for improved handling and storage. Additionally, the bulk bag filling system may also include a dust-tight spout system that assures a positive seal for safe dust-free filling of various powders, e.g., submicron powders. According to another aspect of the present invention, the bulk bag filling system includes a densification system that provides a stable compact stackable bag. According to yet another aspect of the present invention, the bulk bag filling system includes a scale that ensures accurate repeatable filling of bulk bags.

It should be appreciated that many of the independent features that may be incorporated in a bulk bag filling system, designed according to the present invention, are optional. For example, there are different types of hooks (or hangers) available for receiving bag loops. Depending upon how a purchaser wishes to configure their bulk bag filling system, automatically actuated hooks or manual hooks may be employed. When hooks are automatically actuated, the hooks may or may not have a "loading" position. The hanger subsystem may be rotational or stationary. Rotational hanger subsystems may be automatically or manually rotated. The fill head may or may not move in and out. If the system includes a horizontally movable fill head, the fill head may be automatically or manually actuated. In systems that do not include a moveable fill head, an inflatable seal is typically not required between the fill head and the inlet tube. The fill head may or may not move up and down. If the system includes a vertically moveable fill head, the fill head may be automatically or manually actuated.

The controls of the bulk bag filling system may or may not be "processor based." That is, the system may use standard industrial controls and relay logic. The inflatable spout seal is optional and in systems that do not employ an inflatable seal, there are several other methods of attaching/sealing the spout to the fill head. In systems that do include a densifier, an isolation system is not required. The scale system is optional—if there is a scale system, it may or may not be used to control the filling cycle. That is, the scale system may only provide the operator with a numeric readout so that the operator knows how much material is contained within the bag.

Figure 1:
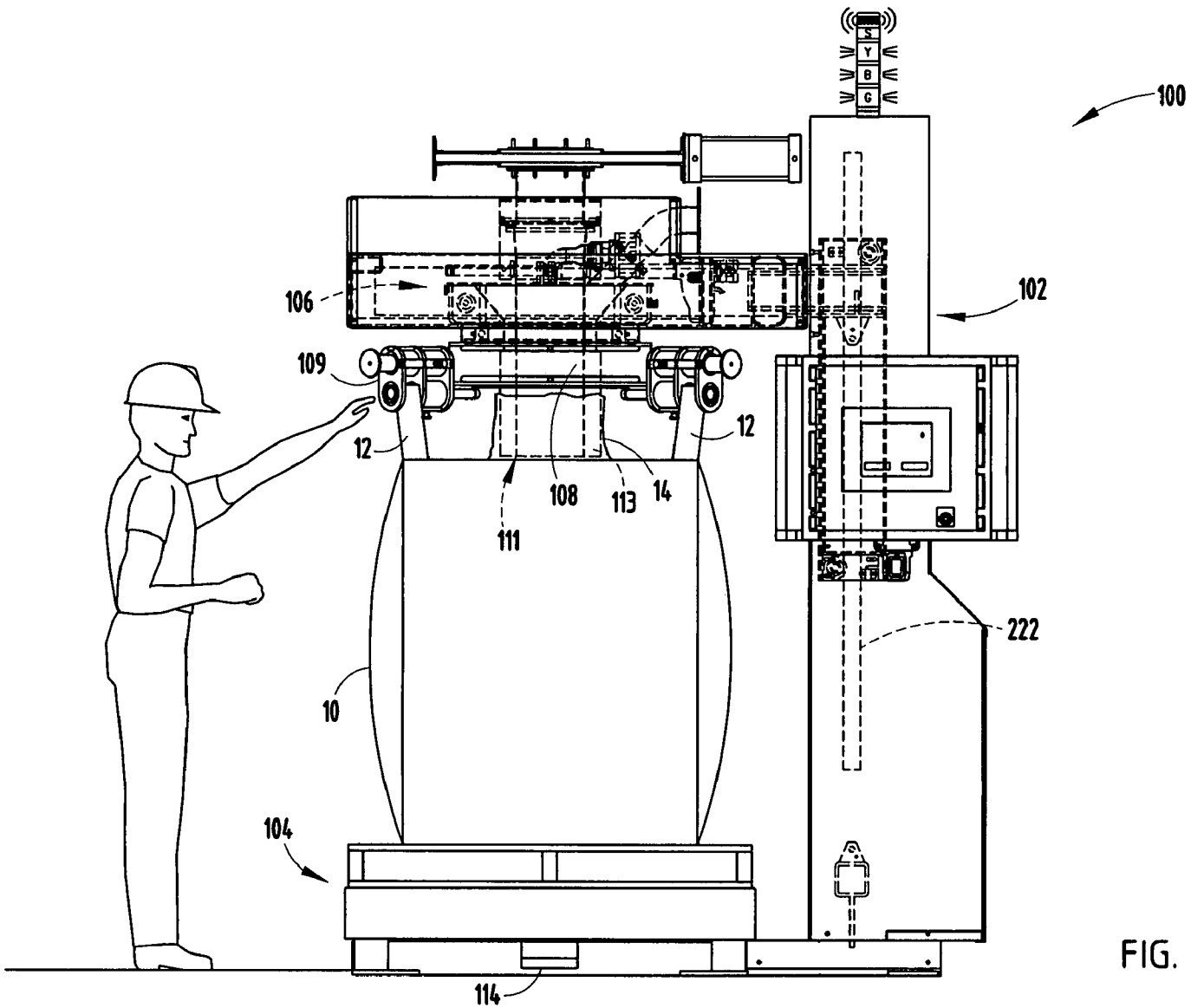
FIG. 1 is a side view of a relevant portion of a bulk bag filling system, constructed according to one embodiment of the present invention.

With reference to FIG. 1, a bulk bag filling system 100 includes a frame 102 that has a base 104 extending therefrom. As is shown in FIG. 1, a bulk bag 10 includes a plurality of bag loops 12, each of which have been received by a bag loop hanger 109 of a rotary carriage 108. As is shown, a neck 14 of the bag 10 is received on a spout 111 that extends below the rotary carriage 108. A seal 113 of a spout seal inflation subsystem seals the neck 14 of the bag 10 to the spout 111. An air amplifier bag inflation subsystem may be implemented to inflate the bag 10 for receiving a bulk material. When implemented, the air amplifier bag inflations subsystem may implement one or more filters 218A (see FIG. 2E). A vibrator 114, e.g., a non-impacting linear vibrator, may be located within the base 104 and may be periodically activated, responsive to readings provided by a scale, to ensure that the bulk material received in the bag 10 fills the bag 10 in a uniform manner. The readings provided by the scale may also be used by a control unit to automatically release a bag.

Figure 1A:
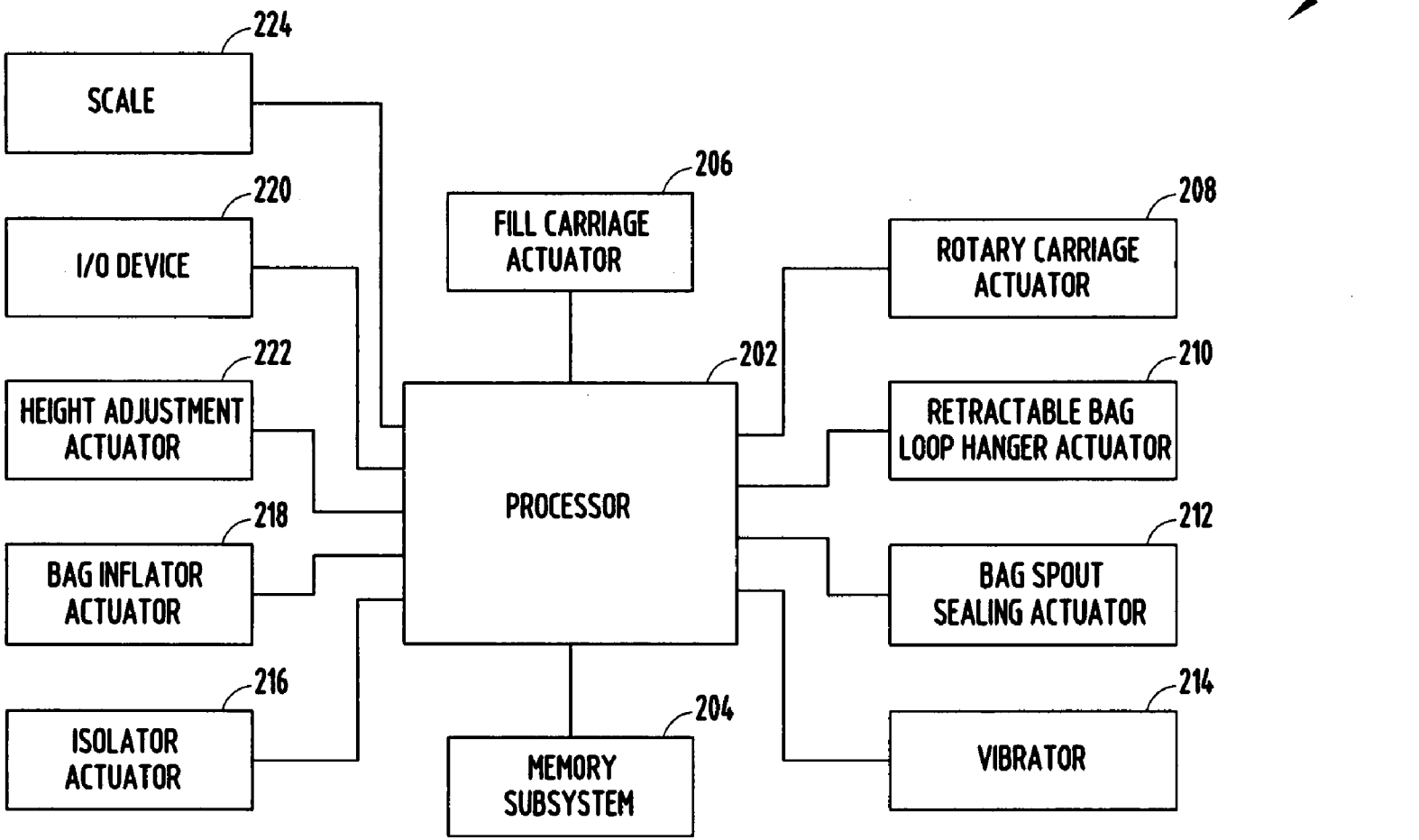
FIG. 1A is an exemplary electrical block diagram of an electrical subsystem for the bulk bag filling system of FIG. 1.

With reference to FIG. 1A, an exemplary electrical block diagram of an electrical subsystem 200 for the bulk bag filling system 100 is shown. The subsystem 200 includes a processor 202 that is coupled to a memory subsystem 204. The processor 202 may take various forms, such as a programmable logic device (PLD), and the memory subsystem 204 includes an application appropriate amount of volatile and non-volatile memory. The processor 202 may also be coupled to an isolator actuator (e.g., a pneumatic actuator) 216, which, when implemented, allows the processor 202 to isolate the frame 102 from the vibration provided by vibrator 214. The processor 202 is coupled to the vibrator 214 and periodically, e.g., responsive to a reading provided by scale 224, controls activation of the vibrator 214 to ensure that the bulk bag 10 is properly loaded. The processor 202 is also coupled to the scale 224, which provides a signal indicative of the weight of the bag 10, such that the processor 202 can determine the weight of the bag 10 and initiate a desired task, such as discontinue filling of the bag 10 when the bag 10 has reached a desired weight. The processor 202 is also coupled to and controls a height adjustment actuator (e.g., an electric actuator) 222, which is coupled to the frame 102, to position a fill carriage 106 at an appropriate height. For example, when the fill carriage 106 is positioned in a bag loading position, the processor 202 controls the height adjustment actuator 222 to adjust the height of the fill carriage 106 to an operator selectable height.

After the bag 10 is full, as indicated by the scale 224, the processor 202 controls a retractable bag loop hanger actuator (e.g., a pneumatic actuator) 210 to release the loops 12 of the bag 10 and adjust the height of the fill carriage 106 by sending an appropriate signal to the height adjustment actuator 222, such that the bag 10 can be readily unloaded. The processor 202 is in communication with an I/O device 220, which allows an operator of the system 100 to select appropriate operating conditions and to receive various information, e.g., the weight of a bag. The processor 202 is also coupled to a fill carriage actuator (e.g., an electric actuator) 206 and may be coupled to a rotary carriage actuator 208 (when implemented). The processor 202 controls the fill carriage actuator 206, typically between one of two positions, i.e., a bag loading position and a bag filling position. When the rotary carriage actuator 208 is implemented, the processor 202 may control rotation of the plurality of bag loop hangers 109 to allow an operator to readily insert the bag loops 12 over the bag loop capture pins 109A of the bag loop hangers 109. Alternatively, when the rotary carriage actuator 208 is not implemented, the rotary carriage 108 may be rotated in a manual manner by the operator. As is briefly mentioned above, the processor 202 is coupled to a retractable bag loop hanger actuator 210 and controls the position of the bag loop capture pin 109A to either be in a bag loop receive position or a bag loop capture position. It should be appreciated that when the bag loops 12 are released that the bag loop capture pins 109A are positioned in a bag loop receive position. The processor 202 is also coupled to a bag spout sealing actuator 212, which allows the processor 202 to seal the neck 14 of the bag 10 to the spout 111.

Figure 1C:
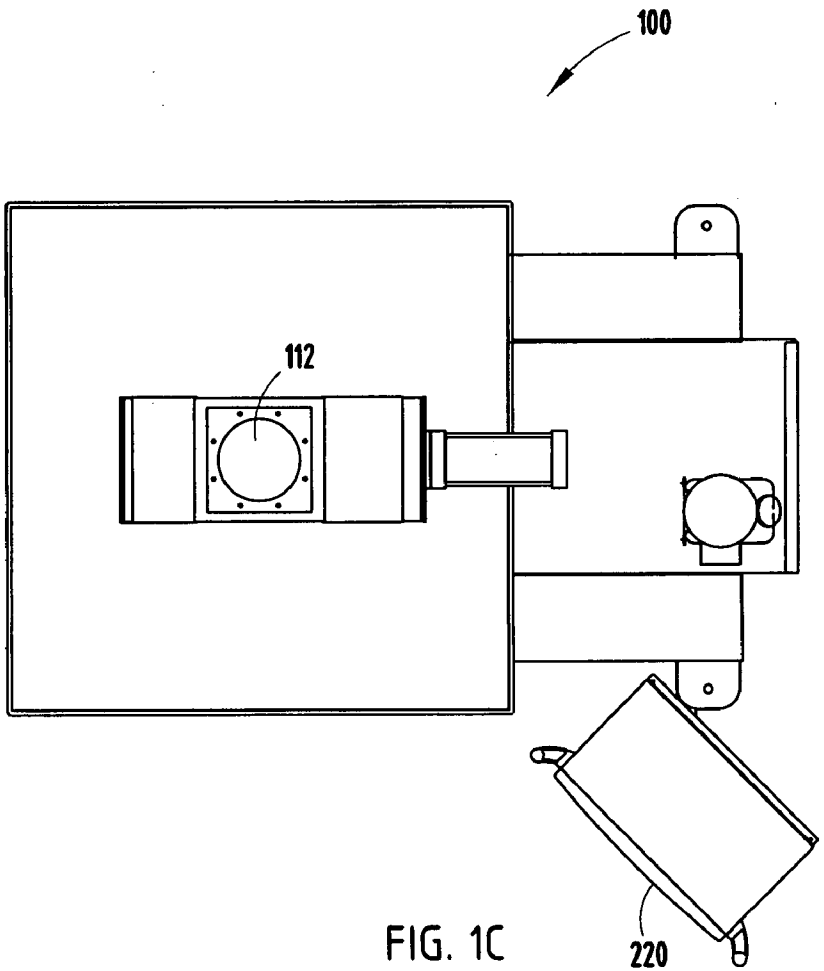
FIG. 1C is a top view of the bulk bag filling system of FIG. 1.
Figure 1B:
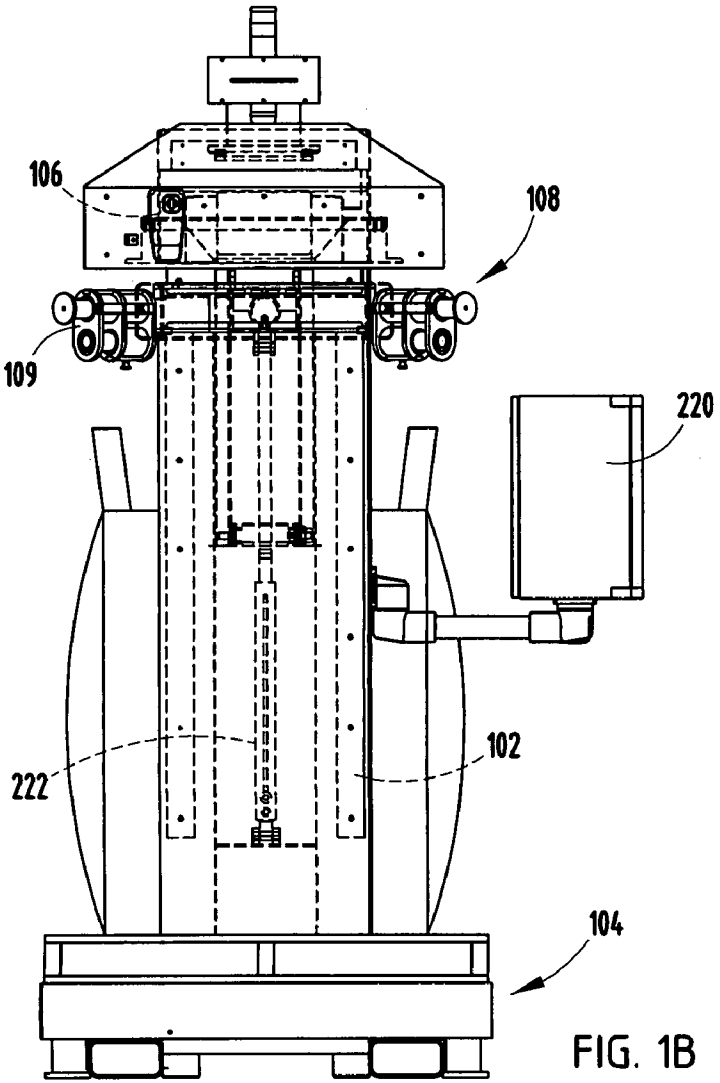
FIG. 1B is a rear view of the bulk bag filling system of FIG. 1.

With reference to FIG. 1B, the location of the height adjustment actuator 222 is shown as contained within the frame 102 and extending toward the base 104. As is discussed in detail above, the height adjustment actuator 222 is used to adjust the height of the fill carriage 106 to an operator selectable height when the fill carriage 106 is positioned in the bag loading position (see FIG. 3A). The height adjustment actuator 222 is also utilized to adjust the height of the fill carriage 106 to a bag filling position height, when the fill carriage 106 is positioned in the bag filling position (see FIG. 3B). Additionally, the height adjustment actuator 222 is used to adjust the height of the fill carriage 106 to a bag unloading position height, when the scale 224 indicates that the bag 10 has reached a desired weight (see FIG. 3C). As is also discussed above, the rotary carriage 108 includes a plurality of bag loop hangers 109 extending therefrom. FIG. 1C shows a top schematic view of the bulk bag filling system 100.

Figure 2B:
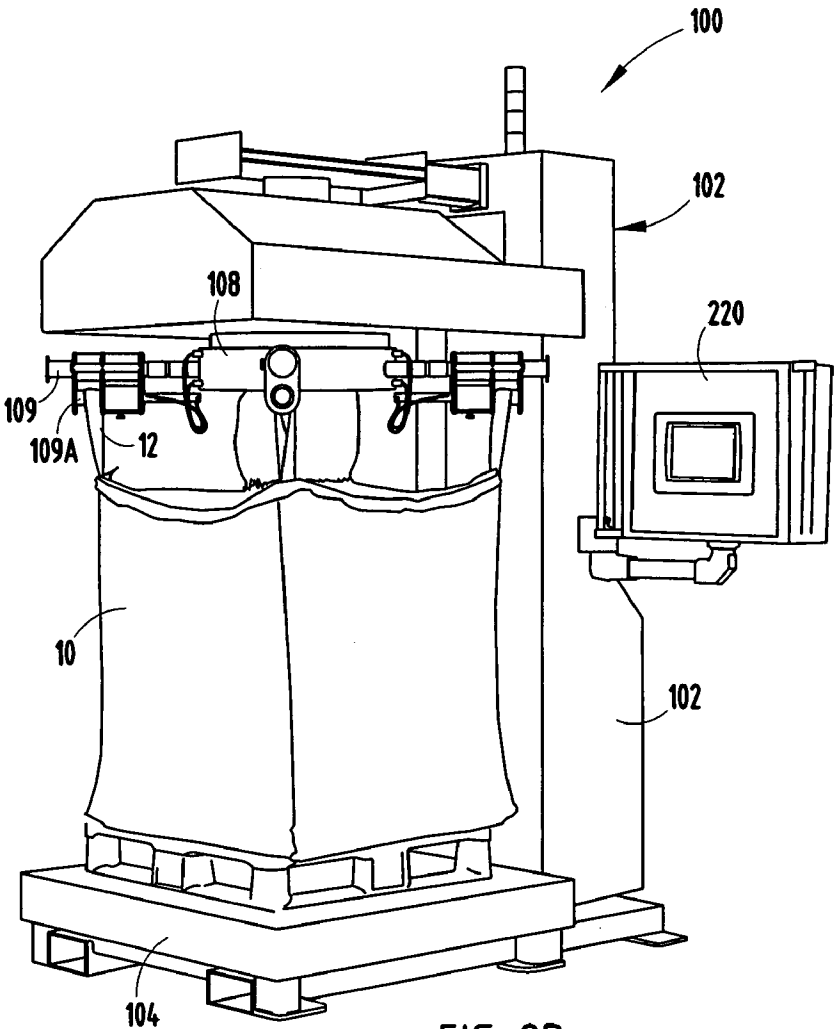
FIG. 2B is a perspective view of the bulk bag filling system of FIG. 2A, including an inflated bag attached to the rotary carriage and the spout of the system.
Figure 2A:
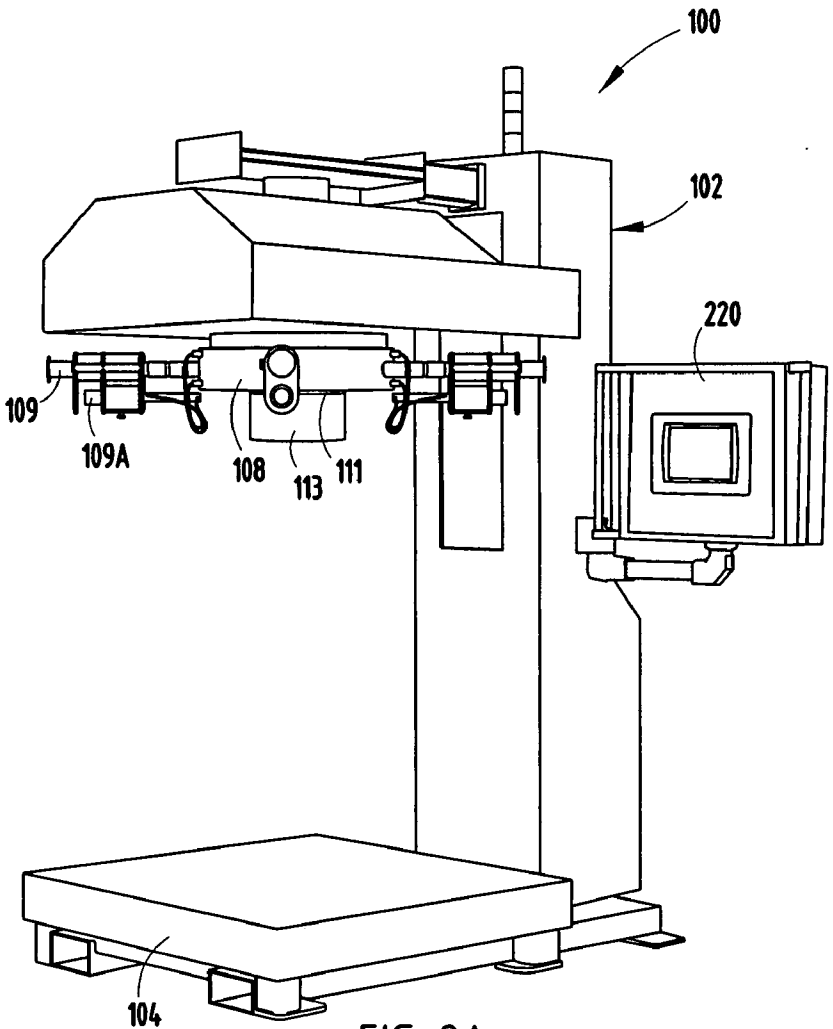
FIG. 2A is a perspective view of a bulk bag filling system constructed according to one embodiment of the present invention, without a bag attached to the spout, which extends from the rotary carriage.

With reference to FIG. 2A, a perspective view of the bulk bag filling system 100 is depicted. As is shown in FIG. 2A, each of the bag loop hangers 109 includes a bag loop capture pin 109A, which is controlled to capture or release a bag loop 12 of the bag 10 (not shown in FIG. 2A). An inflatable seal 113 is shown located on the spout 111, which extends below the rotary carriage 108. When the neck 14 of the bag 10 is positioned on the spout 111, the bag spout sealing actuator 212 is activated to seal the neck 14 of the bag 10 and the spout 111.

Figure 2D:
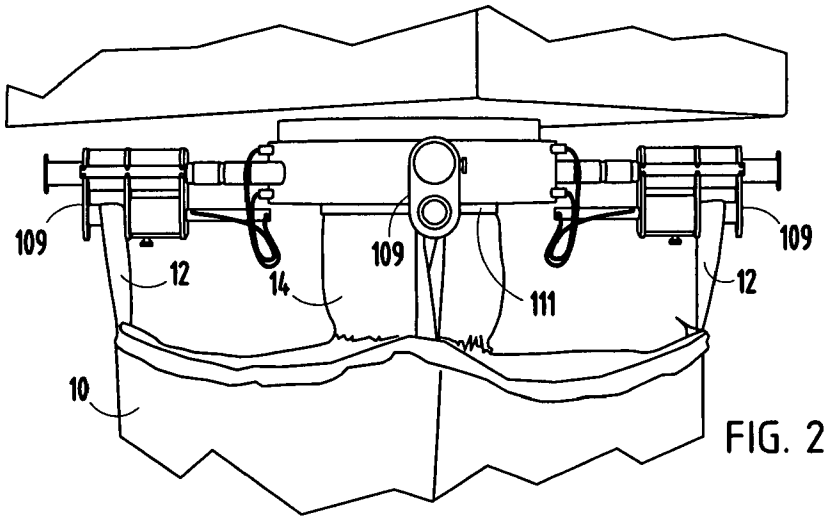
FIG. 2D is an enlarged perspective view of the rotary carriage of the bulk bag filling system of FIG. 2A.
Figure 2E:
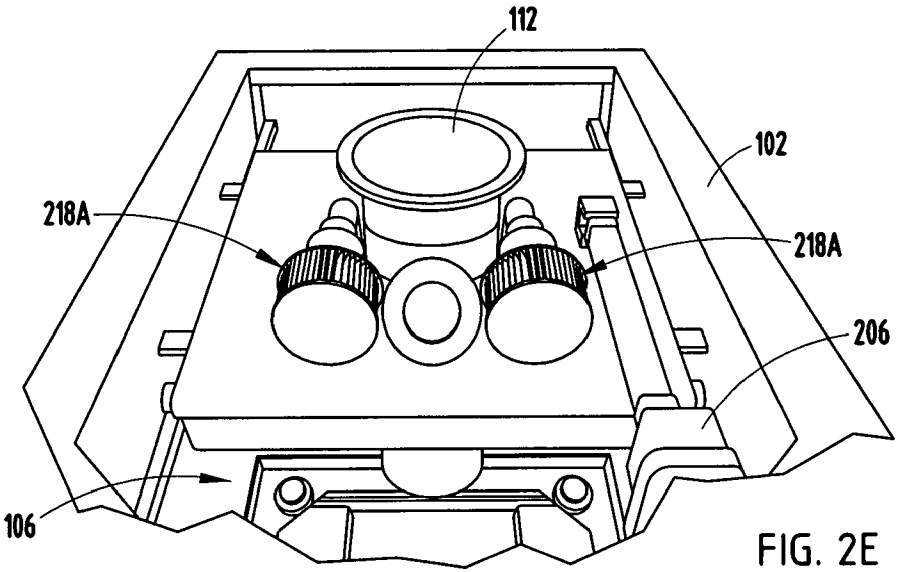
FIG. 2E is an enlarged top perspective view of a fill carriage movably coupled to a frame of the bulk bag filling system of FIG. 2A.
Figure 2C:
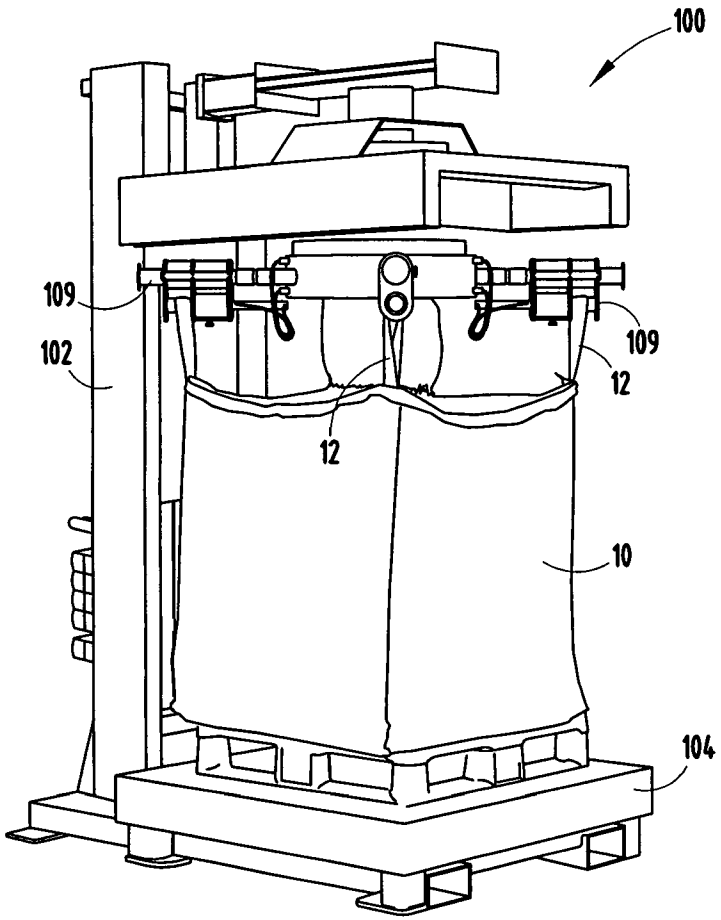
FIG. 2C is another perspective view of a bulk bag filling system, with a bulk bag connected to a rotary head of the bulk bag filling system, with various safety covers removed.
Figure 2F:
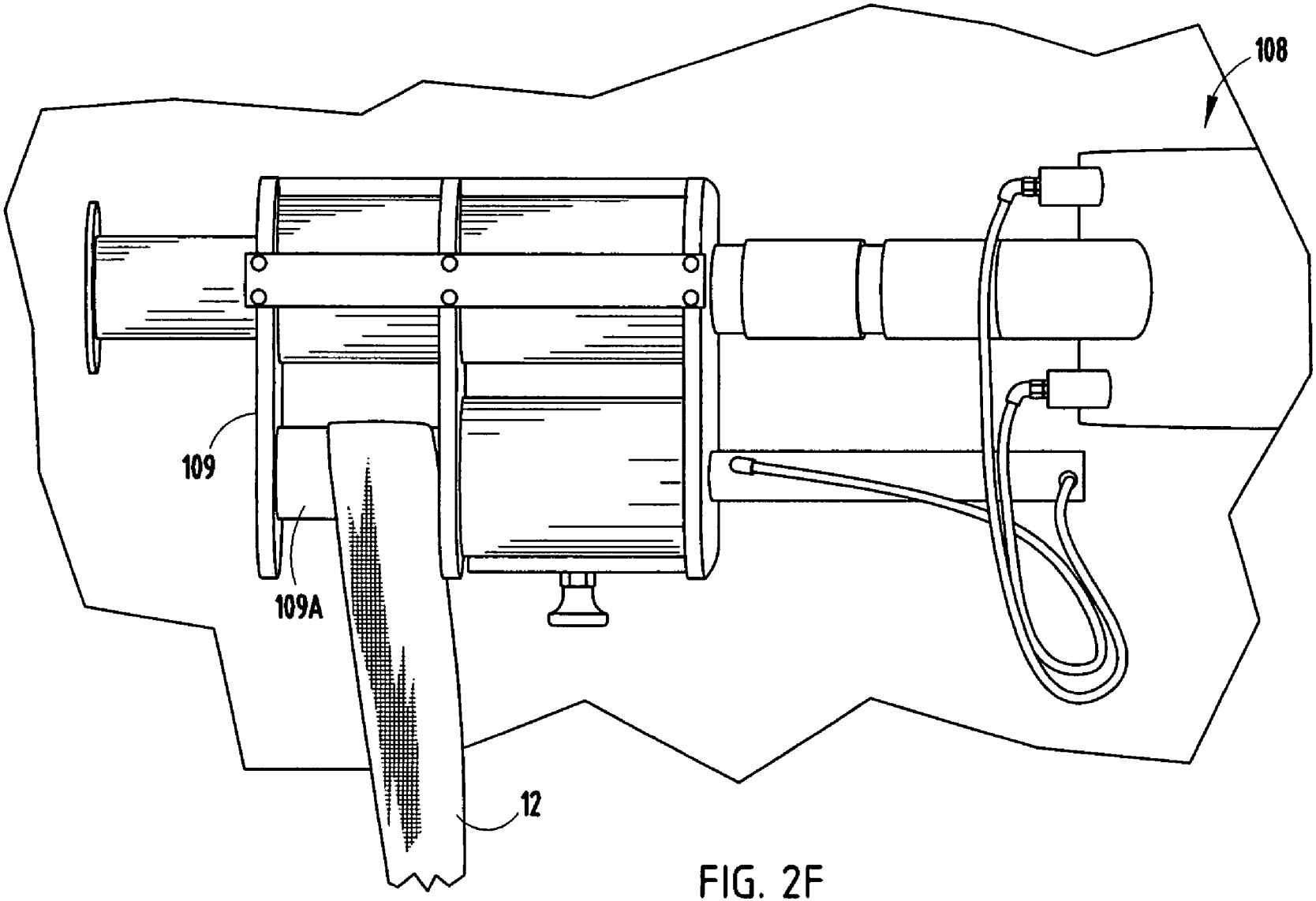
FIG. 2F is an enlarged perspective view of one of the bag loop hangers of the rotary carriage of the bulk bag filling system, with a bag loop of a bag to be filled retained by a bag loop capture pin.

With reference to FIG. 2B, a bag 10 (and a pallet) is shown positioned on the base 104 in a bag fill position. The bag loops 12 of the bag 10 are captured by the pins 109A, thus, attaching the bag loops 12 to the bag loop hangers 109. Referring to FIG. 2C, the bulk bag filling system 100 is depicted with a number of safety covers removed. Similar to the view of FIG. 2B, the view of FIG. 2C shows the bulk bag filling system 100 in a bag filling position with a bag 10 attached to the spout 111. FIG. 2D depicts a close-up view of the rotary carriage 108 and depicts the neck 14 of the bag 10 positioned on and sealed to the spout 111, which extends through and below the rotary carriage 108. With reference to FIG. 2E, a top view of a relevant portion of the fill carriage 106 is depicted. The fill carriage 106 is controlled by a fill carriage actuator 206 and includes a fill port 112, for receiving bulk materials, and one or more filter 218A to be used in conjunction with the bag inflator actuator 218. Turning to FIG. 2F, a bag loop 12 is shown captured by a pin 109A of a bag loop hanger 109 of the rotary carriage 108.

Figure 3A:
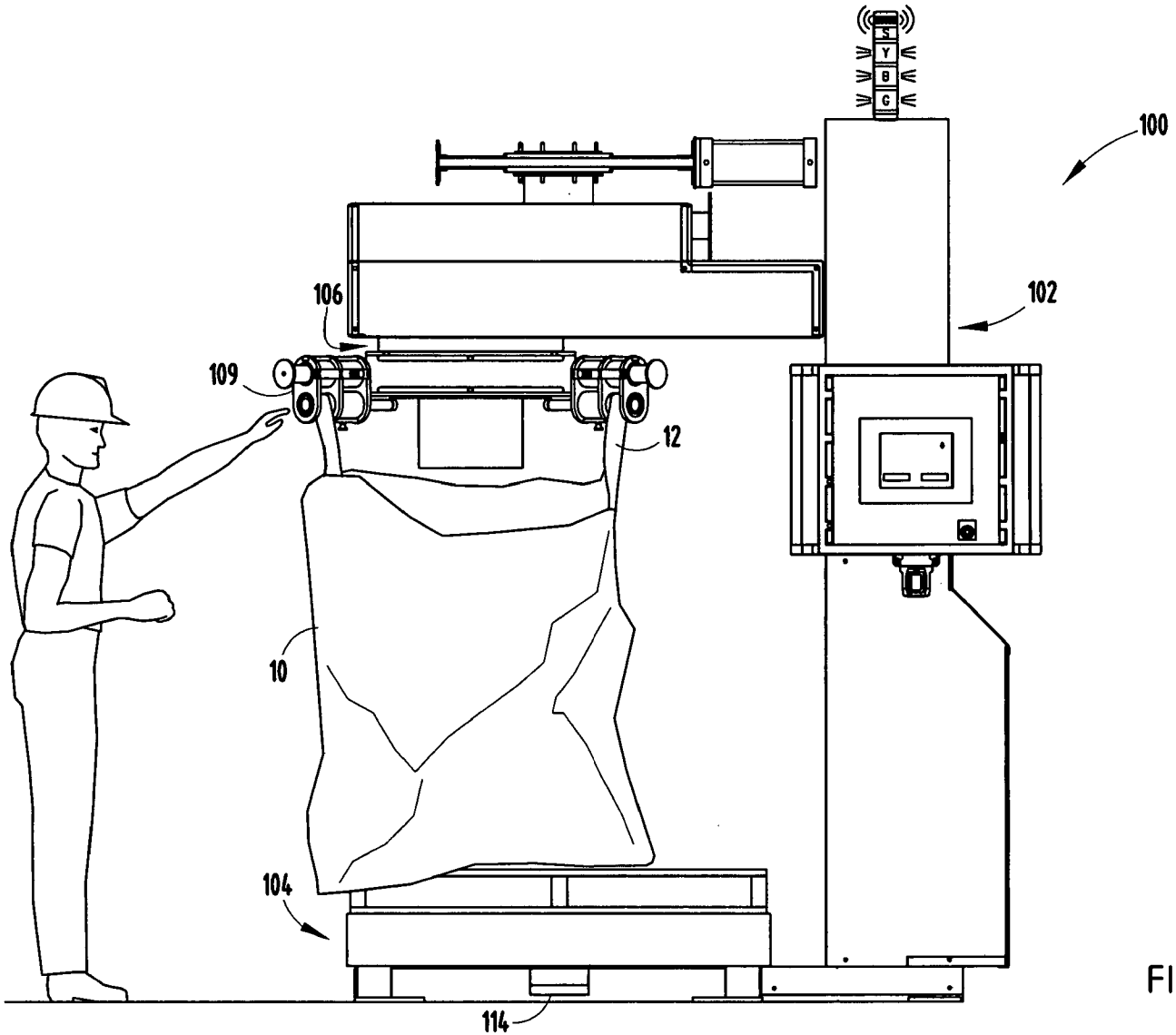
FIG. 3A is a side view of a bulk bag filling system of FIG. 2A, with the fill carriage positioned in a bag loading position.
Figure 3B:
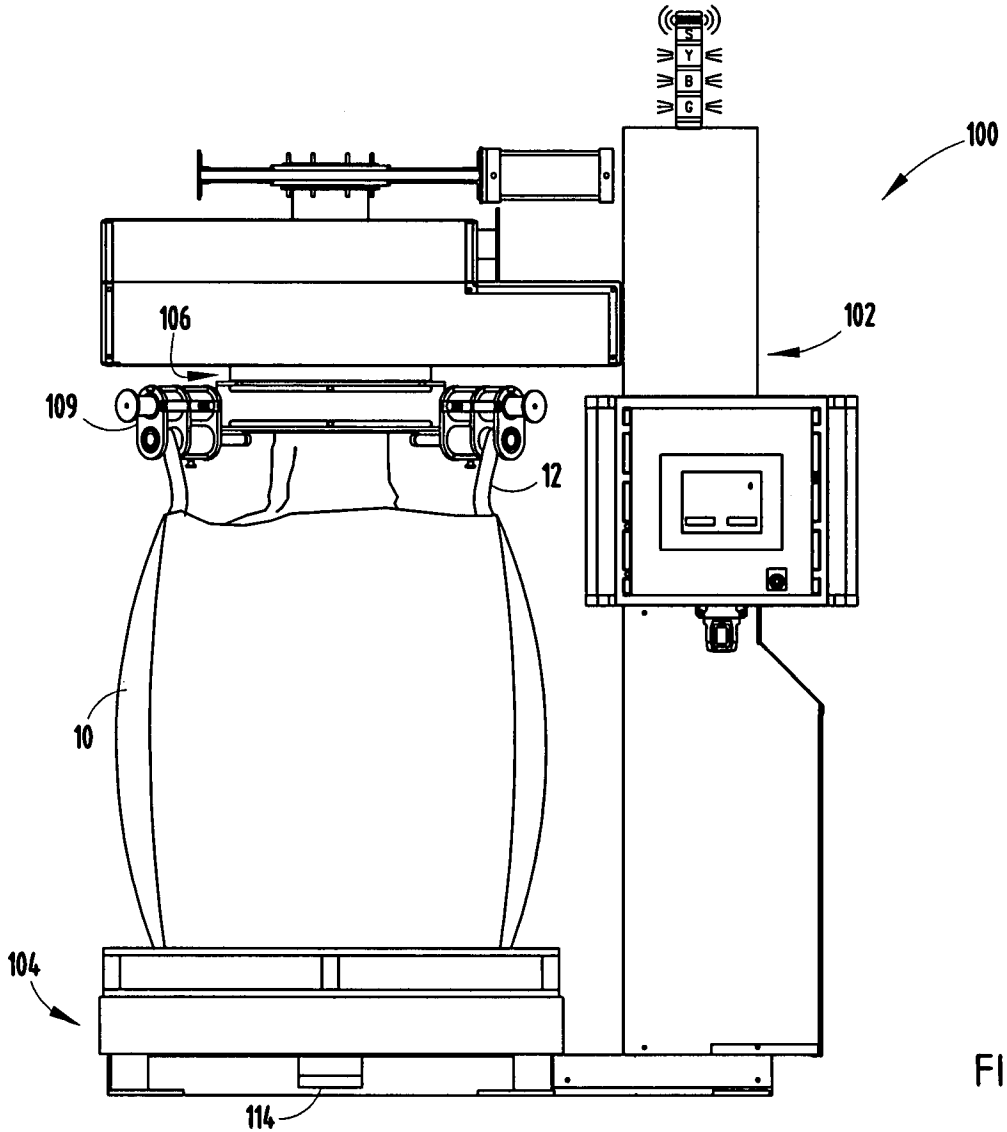
FIG. 3B is a side view of a bulk bag filling system of FIG. 2A, including a fill bag, and positioned in a bag filling position to fill the bag with bulk materials.
Figure 3C:
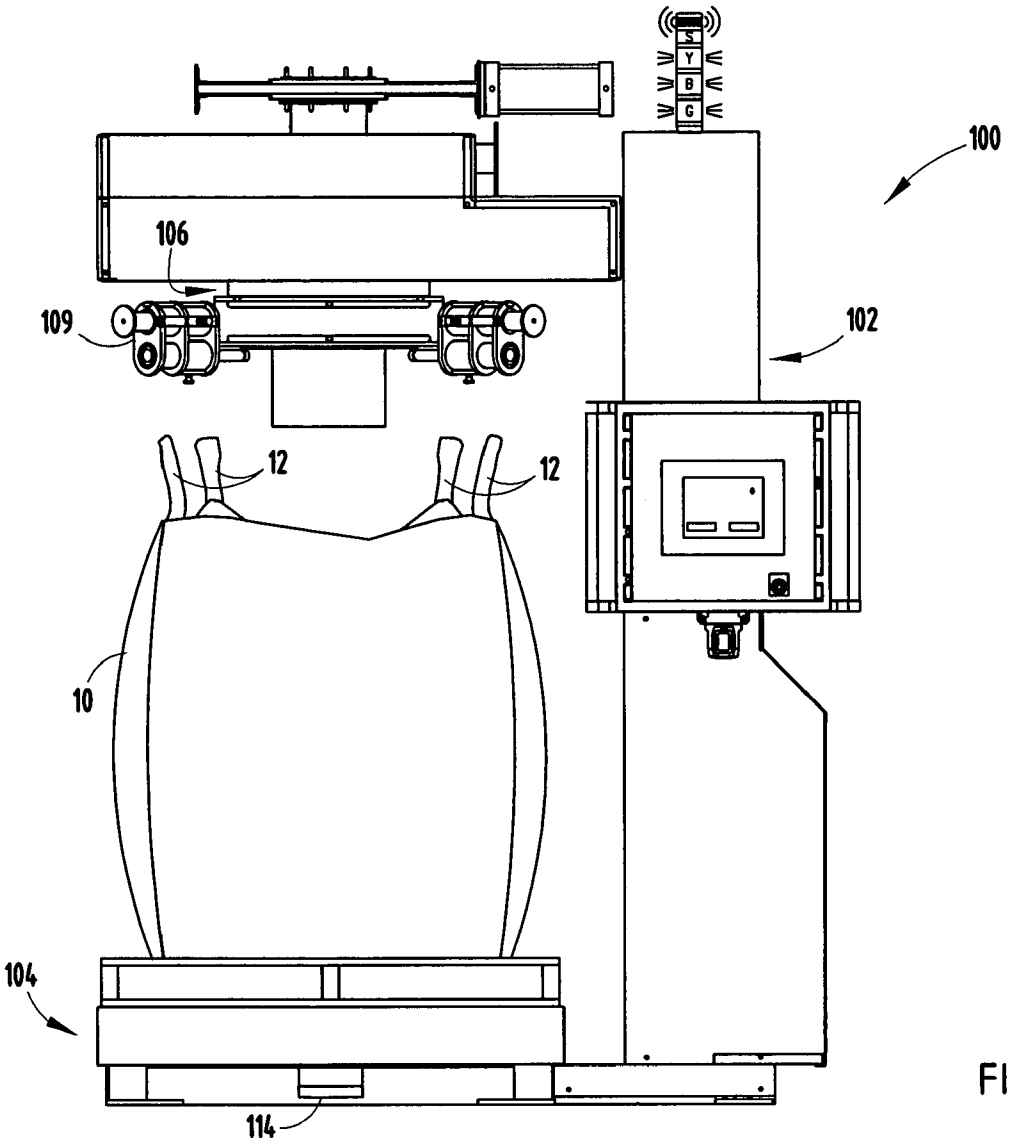
FIG. 3C is a side view of a bulk bag filling system of FIG. 2A, with the height adjustment actuator adjusted to position the fill carriage in a bag unloading position.

With reference to FIG. 3A, the bulk bag filling system 100 is shown, with the fill head 106 (and the rotary head 108) lowered and extended toward the operator to allow the operator to efficiently mount the bag 10 to the bag loop hangers 109 of the rotary carriage 108. The fill head 106 may implement, for example, cam rollers in conjunction with a truck and carriage to achieve horizontal motion. As briefly mentioned above, the rotary carriage 108 can include an actuator for rotating the rotary carriage 108 or the rotary carriage 108 can be operated manually by the operator. Upon connecting the bag 10 to the bag loop hangers 109 of the rotary carriage 108, the spout seal 113 is inflated and the fill head 106 is then raised and retracted to the fill position, as is shown in FIG. 3B. Upon reaching the fill position, the bag 10 is inflated and the inlet valve automatically actuates, as required for accurate weighing. The densification system turns on and off at a programmed interval, based on, for example weight, during the fill process to ensure a safe stackable bag. As is depicted in FIG. 3C, when the fill cycle is complete, the bag loops (straps) 12 of the bag 10 are released, at which point the fill head 106 is raised to allow the fill bag 10 to be removed from the base 104. The structure for raising and lowering the fill head 106 may implement, for example, a wide variety of actuators in conjunction with cam rollers. As noted above, the bag attachment height may be manually or automatically changed. For example, height adjustment of the fill head 106 may be achieved by one or more hydraulic rams, pneumatic cylinders, a manual positioning device (e.g., a pin and post configuration), a manual crank or an electro-mechanical device (e.g., a motor with associated drive gears).

Accordingly, a bulk bag filling system has been described herein that advantageously positions a fill carriage (including a rotary head) to allow an operator to attach a bag to the system for filling. The system may also advantageously include a bag inflation subsystem that ensures the bag is properly filled for improved handling and storage. In systems that implement a dust-tight spout subsystem, a positive seal may be provided for safe, dust-free filling of submicron powders. As previously discussed, a densification system, when implemented, provides a stable compact stackable bag and an integrated weight scale allows for accurate repeatable filling, among other functions The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

What is claimed is:

1. A bulk bag filling system, comprising:

a frame including a base;

an input/output device attached to the frame, wherein the input/output device is configured to receive input from an operator and provide output to the operator;

a fill carriage movably coupled to the frame and including a fill carriage actuator for effecting movement of the fill carriage, wherein the fill carriage is alignable with a fill port for receiving a bulk material;

a rotary carriage including a plurality of bag loop hangers for receiving bag loops of a bag to be filled, wherein the rotary carriage is movably coupled to the fill carriage and a spout for receiving a neck of the bag to be filled extends through the rotary carriage, and wherein the spout is alignable with the fill port and the rotary carriage includes at least one bag loop hanger actuator for effecting movement of a bag loop capture pin of the bag loop hangers;

a processor coupled to the input/output device, the fill carriage actuator and the bag loop hanger actuator; and a memory subsystem coupled to the processor, the memory subsystem storing code that responsive to input from an operator instructs the processor to perform the steps of:

controlling the fill carriage actuator to position the fill carriage into a bag loading position;

controlling the bag loop hanger actuator to position the bag loop capture pin in a bag loop receive position;

controlling the bag loop hanger actuator to position the bag loop capture pin in a bag loop capture position; and controlling the fill carriage actuator to position the fill carriage and the bag into a bag filling position.

2. The system of claim 1, further comprising:

a bag spout sealing subsystem positioned adjacent the spout, the bag spout sealing subsystem including a bag spout sealing actuator;

a bag inflator subsystem including a bag inflator actuator, wherein the bag spout sealing actuator and the bag inflator actuator are coupled to the processor and the memory subsystem stores additional code that responsive to input provided by the operator instructs the processor to perform the additional steps of:

controlling the bag sealing actuator to seal the neck of the bag and the spout; and controlling the bag inflator actuator to inflate the bag for receiving the bulk material.

3. The system of claim 1, further comprising:

a vibrator positioned in the base, wherein the vibrator is coupled to the processor and the memory subsystem stores additional code that instructs the processor to perform the additional step of:

controlling the vibrator to vibrate the bulk material within the bag as the bag is filled.

4. The system of claim 1, further comprising:

a scale positioned in the base, wherein the scale is coupled to the processor and the memory subsystem stores additional code that instructs the processor to perform the additional step of:

reading the scale to determine the weight of the bulk material within the bag as the bag is filled.

5. The system of claim 1, wherein the rotary carriage includes a rotary carriage actuator for effecting rotary movement of the rotary carriage, and wherein the rotary carriage actuator is coupled to and controlled by the processor.

6. The system of claim 4, further comprising:

a height adjustment actuator attached between the frame and the fill carriage for adjusting a vertical position of the fill carriage with respect to the frame, wherein the height adjustment actuator is coupled to the processor and the memory subsystem stores additional code that instructs the processor to perform the additional steps of:

controlling the height adjustment actuator to adjust the height of the fill carriage to an operator selectable height when the fill carriage is positioned in the bag loading position;

controlling the height adjustment actuator to adjust the height of the fill carriage to a bag filling position height when the fill carriage is positioned in the bag filling position;

controlling the bag loop hanger actuator to position the bag loop capture pin in the bag loop receive position to release the bag loops; and controlling the height adjustment actuator to adjust the height of the fill carriage to a bag unloading position height when the scale indicates that the bag has reached a desired weight.

7. A bulk bag filling system, comprising:

a frame including a base;

a fill carriage coupled to the frame, wherein the fill carriage is alignable with a fill port for receiving a bulk material; and a rotary carriage spaced around a spout extending through the rotary carriage and a plurality of bag loop hangers for receiving bag loops of a bag to be filled, wherein the rotary carriage is movably coupled to the fill carriage, and wherein the spout is alignable with the fill port and wherein the bag loop hangers extend laterally from the rotary carriage and wherein the rotary carriage is rotatable about the spout.

8. The system of claim 7, further comprising:

an input/output device attached to the frame, wherein the input/output device is configured to receive input from an operator and provide output to the operator and at least one bag loop hanger actuator for effecting movement of a bag loop capture pin of the bag loop hangers, and where the fill carriage is movably coupled to the frame and includes a fill carriage actuator for effecting movement of the fill carriage;

a processor coupled to the input/output device, the fill carriage actuator and the bag loop hanger actuator; and a memory subsystem coupled to the processor, the memory subsystem storing code that responsive to input from an operator instructs the processor to perform the steps of:

controlling the fill carriage actuator to position the fill carriage into a bag loading position;

controlling the bag loop hanger actuator to position the bag loop capture pin in a bag loop receive position;

controlling the bag loop hanger actuator to position the bag loop capture pin in a bag loop capture position; and controlling the fill carriage actuator to position the fill carriage and the bag into a bag filling position.

9. The system of claim 8, further comprising:

a bag spout sealing subsystem positioned adjacent the spout, the bag spout sealing subsystem including a bag spout sealing actuator; and a bag inflator subsystem including a bag inflator actuator, wherein the bag spout sealing actuator and the bag inflator actuator are coupled to the processor and the memory subsystem stores additional code that responsive to input provided by the operator instructs the processor to perform the additional steps of:

controlling the bag sealing actuator to seal the neck of the bag and the spout; and controlling the bag inflator actuator to inflate the bag for receiving the bulk material.

10. The system of claim 9, further comprising:

a vibrator positioned in the base, wherein the vibrator is coupled to the processor and the memory subsystem stores additional code that instructs the processor to perform the additional step of:

controlling the vibrator to vibrate the bulk material within the bag as the bag is filled.

11. The system of claim 10, further comprising:

a scale positioned in the base, wherein the scale is coupled to the processor and the memory subsystem stores additional code that instructs the processor to perform the additional step of:

reading the scale to determine the weight of the bulk material within the bag as the bag is filled.

12. The system of claim 11, wherein the rotary carriage includes a rotary carriage actuator for effecting rotary movement of the rotary carriage, and wherein the rotary carriage actuator is coupled to and controlled by the processor.

13. The system of claim 12, further comprising:

a height adjustment actuator attached between the frame and the fill carriage for adjusting a vertical position of the fill carriage with respect to the frame, wherein the height adjustment actuator is coupled to the processor and the memory subsystem stores additional code that instructs the processor to perform the additional steps of:

controlling the height adjustment actuator to adjust the height of the fill carriage to an operator selectable height when the fill carriage is positioned in the bag loading position;

controlling the height adjustment actuator to adjust the height of the fill carriage to a bag filling position height when the fill carriage is positioned in the bag filling position;

controlling the bag loop hanger actuator to position the bag loop capture pin in the bag loop receive position to release the bag loops; and controlling the height adjustment actuator to adjust the height of the fill carriage to a bag unloading position height when the scale indicates that the bag has reached a desired weight.

14. A bulk bag filling system, comprising:

a frame including a base;

a fill carriage coupled to the frame, wherein the fill carriage is alignable with a fill port for receiving a bulk material;

a height adjustment actuator attached between the frame and the fill carriage for adjusting a vertical position of the fill carriage with respect to the frame;

a rotary carriage movably coupled to the fill carriage and wherein a spout for receiving a neck of the bag to be filled extends through the rotary carriage, and wherein the spout is alignable with the fill port; and wherein the rotary carriage is rotatable about the spout; and a plurality of bag loop hangers for receiving bag loops of a bulk bag to be filled wherein the bag loop hangers each comprise a bag loop capture pin and wherein the bag loop hangers extend laterally from the rotary carriage.

15. The system of claim 14, further comprising:

an input/output device attached to the frame, wherein the input/output device is configured to receive input from an operator and provide output to the operator, and wherein the rotary carriage includes at least one bag loop hanger actuator for effecting movement of the bag loop capture pin of the bag loop hangers, and where the fill carriage is movably coupled to the frame and includes a fill carriage actuator for effecting movement of the fill carriage;

a processor coupled to the input/output device, the fill carriage actuator and the bag loop hanger actuator; and a memory subsystem coupled to the processor, the memory subsystem storing code that responsive to input from an operator instructs the processor to perform the steps of:

controlling the fill carriage actuator to position the fill carriage into a bag loading position;

controlling the bag loop hanger actuator to position the bag loop capture pin in a bag loop receive position;

controlling the bag loop hanger actuator to position the bag loop capture pin in a bag loop capture position; and controlling the fill carriage actuator to position the fill carriage and the bag into a bag filling position.

16. The system of claim 15, further comprising:

a bag spout sealing subsystem positioned adjacent the spout, the bag spout sealing subsystem including a bag spout sealing actuator; and a bag inflator subsystem including a bag inflator actuator, wherein the bag spout sealing actuator and the bag inflator actuator are coupled to the processor and the memory subsystem stores additional code that responsive to input provided by the operator instructs the processor to perform the additional steps of:

controlling the bag sealing actuator to seal the neck of the bag and the spout; and controlling the bag inflator actuator to inflate the bag for receiving the bulk material.

17. The system of claim 15, further comprising:

a vibrator positioned in the base, wherein the vibrator is coupled to the processor and the memory subsystem stores additional code that instructs the processor to perform the additional step of:

controlling the vibrator to vibrate the bulk material within the bag as the bag is filled.

18. The system of claim 15, further comprising:

a scale positioned in the base, wherein the scale is coupled to the processor and the memory subsystem stores additional code that instructs the processor to perform the additional step of:

reading the scale to determine the weight of the bulk material within the bag as the bag is filled.

19. The system of claim 15, wherein the rotary carriage includes a rotary carriage actuator for effecting rotary movement of the rotary carriage, and wherein the rotary carriage actuator is coupled to and controlled by the processor.

20. The system of claim 15, wherein the height adjustment actuator is coupled to the processor and the memory subsystem stores additional code that instructs the processor to perform the additional steps of:

controlling the height adjustment actuator to adjust the height of the fill carriage to an operator selectable height when the fill carriage is positioned in the bag loading position;

controlling the height adjustment actuator to adjust the height of the fill carriage to a bag filling position height when the fill carriage is positioned in the bag filling position;

controlling the bag loop hanger actuator to position the bag loop capture pin in the bag loop receive position to release the bag loops; and controlling the height adjustment actuator to adjust the height of the fill carriage to a bag unloading position height when the scale indicates that the bag has reached a desired weight.

21. The bulk bag filling system of claim 7, wherein each bag loop hanger comprises a bag loop capture pin and wherein the rotary carriage is circular.

* * * * *